US007882988B2

(12) United States Patent
Nicolle et al.

(10) Patent No.: US 7,882,988 B2
(45) Date of Patent: Feb. 8, 2011

(54) PUMP FOR DISPENSING A LIQUID PRODUCT WITH IMPROVED PRIMING

(75) Inventors: Francois Nicolle, Domicile (FR); David Leuliet, Domicile (FR)

(73) Assignee: Rexam Dispensing Systems S.A.S. (FR)

( * ) Notice: Subject to any disclaimer, the term of this patent is extended or adjusted under 35 U.S.C. 154(b) by 407 days.

(21) Appl. No.: 12/143,461

(22) Filed: Jun. 20, 2008

(65) Prior Publication Data

US 2009/0020565 A1 Jan. 22, 2009

(30) Foreign Application Priority Data

Jun. 20, 2007 (FR) ..... 07 55895

(51) Int. Cl.
*B65D 88/54* (2006.01)

(52) U.S. Cl. ..... 222/321.9; 222/340

(58) Field of Classification Search ... 222/319.1–321.9, 222/339, 340, 257, 311, 207, 378–380
See application file for complete search history.

(56) References Cited

U.S. PATENT DOCUMENTS 4,017,031 A * 4/1977 Kishi et al. ..... 239/333
4,154,374 A * 5/1979 Kirk, Jr. ..... 222/321.2
4,991,746 A * 2/1991 Schultz ..... 222/153.13
5,092,495 A * 3/1992 Andre ..... 222/341
5,482,188 A * 1/1996 Lina ..... 222/321.2
5,505,343 A 4/1996 Knickerbocker
5,626,264 A * 5/1997 Florez et al. ..... 222/321.2
5,649,649 A * 7/1997 Marelli ..... 222/321.2
5,655,688 A 8/1997 Moore
5,720,419 A * 2/1998 Li ..... 222/321.2
7,780,044 B2 * 8/2010 Leuliet et al. ..... 222/321.9

FOREIGN PATENT DOCUMENTS

WO 2006125880 A1 11/2006

OTHER PUBLICATIONS

Written Opinion, Jun. 20, 2007. 4 pages.
Preliminary Search Report, Jan. 25, 2008. 2 pages.

* cited by examiner

*Primary Examiner*—Lien T Ngo
(74) *Attorney, Agent, or Firm*—St. Onge Steward Johnston & Reens LLC

(57) ABSTRACT

A pump for dispensing a liquid product, including a pump body and a dispensing head manually movable on the latter, the head including a cylinder forming a dosage chamber of the pump, slidingly mounted in the pump body, and a channel allowing the passage of the product or air from the dosage chamber towards an ejection orifice. The rod includes means for airtightly sealing the channel consisting of a peripheral shoulder capable of coming to a rest against a complementary sealing seat arranged in the cylinder, the opening of the channel being performed by separating the sealing seat from the cylinder opposite the shoulder of the rod after the rod reaching its stop early during the axial movement of the cylinder in the pump body.

11 Claims, 6 Drawing Sheets

PUMP FOR DISPENSING A LIQUID PRODUCT WITH IMPROVED PRIMING

CROSS-REFERENCE TO RELATED APPLICATIONS

The present application claims priority of French patent application No. 07/55895 filed on Jun. 20, 2007, the content of which is incorporated herein by reference.

FIELD OF THE INVENTION

The invention concerns a pump for dispensing a liquid or semi-liquid product, designed in particular for sealing a container containing the liquid product to be dispensed.

The pump according to the invention is particularly, but not exclusively, designed to be used in the pharmaceutical field.

BACKGROUND OF THE INVENTION

The pumps generally used to dispense liquid or semi-liquid products are so-called "needle-valve pumps". Such pumps comprise at the top a needle valve mounted so as to move freely between a closed position in which it blocks the end opening of the pump, and prevents the dispensing of the product, and an open position in which it allows the liquid to pass through said end opening.

Such pumps, in a standard manner, comprise a first cylinder forming a pump chamber, which communicates with an intake tube by means of a check valve, and in which a hollow piston is slidingly mounted. They also comprise a second cylinder, which communicates with the first cylinder, in which a second piston formed by a needle valve is slidingly mounted, capable of interrupting the communication between the first cylinder and a dispensing nozzle. They finally comprise elastic means, such as a metallic compression spring, which act on the needle valve so as to maintain the latter in a blocking position in which said communication is interrupted.

Such pumps have the following operating principle: when the first piston is moved, the liquid located in the first cylinder is forced into the second cylinder, in which the pressure increases. The second piston tends to push into its cylinder, compressing the spring. When the pressure of the liquid reaches a high enough value to balance this action, the second piston moves, driving the valve linked to it, so that the cylinders are placed in communication with the dispensing nozzle.

Such pumps do not comply with the present demands of quality standards since, for example, the liquid product can be polluted through contact with the metal spring that returns the needle valve to blocking position after dispensing the liquid product.

Furthermore, the doses of liquid product dispensed are often inaccurate, which limits the use of these pumps to the dispensing of certain products.

In order to attempt to overcome these disadvantages, patent application WO 2006/125880, filed by the present Applicant, already describes a pump comprising a needle valve made up of a base topped by a rod, and a dispensing head manually movable on a pump body between an inactive position and a punctual product-dispensing position. The head comprises elastic means for respectively returning said needle valve to the position in which it blocks a dispensing orifice and the dispensing head to the inactive position. The return means are arranged in the dispensing head so as not to be in contact with the liquid product to be dispensed. The dispensing head also comprises a channel for allowing the liquid product to pass between the dosage chamber and a second chamber provided at the end of said dispensing head, so as to communicate with the orifice of the dispensing head.

The opening of the dispensing orifice, allowing the liquid product to be ejected towards the outside of the pump, takes place under the action of the pressure exerted by the liquid product contained in the second chamber on the needle valve. More precisely, under the action of a pressure exerted by a user on the dispensing head, the liquid product contained in the dosage chamber is compressed. The latter then exerts a pressure on the liquid product contained in the channel, and indirectly on the liquid product contained in the second chamber. The liquid product contained in the second chamber, exerting a pressure on the base of the needle valve, then compresses the elastic return means of the needle valve. Under this action, the rod of the needle valve separates from the dispensing orifice, freeing up a passage through which the liquid product is ejected to the outside of the pump.

However, this type of pump needs to be primed prior to dispensing the product, which means evacuating the air that was trapped in the dosage chamber, channel and second chamber during the assembly of the pump. The principle of air evacuation is similar to the previously described liquid-product dispensing principle. And yet, the pressure exerted by the air contained in the second dosage chamber is not always enough to separate the needle valve from the dispensing orifice and thus to open the passage for ejecting the air from the pump. This can result in difficulties when priming the pump.

SUMMARY OF THE INVENTION

The invention aims mainly to overcome the previously described disadvantages of the prior art, and more particularly those of patent application WO 2006/125880, by providing a pump with improved priming.

For this purpose, and according to a first aspect, the invention relates to a pump for dispensing a liquid or semi-liquid product, designed to be used in particular in the pharmaceutical or cosmetic field, said pump comprising a pump body and a dispensing head manually movable on the pump body, between an inactive position and a punctual product-dispensing position, the dispensing head comprising a cylinder forming a dosage chamber of the pump, chamber which communicates with a liquid intake tube by means of an intake valve, said cylinder being slidingly mounted in the pump body, and a channel for allowing the product or air to pass from the dosage chamber towards an orifice for ejecting the liquid product or the air.

The pump is remarkable in that the dispensing head comprises an exhaust valve made up of a rod slidingly mounted inside the cylinder, the bottom end of which seals the dosage chamber at the top, the rod comprising means for airtightly sealing the channel consisting of a peripheral shoulder capable of coming to rest against a matching sealing seat arranged in the cylinder, the channel being opened by separating the sealing seat from the cylinder opposite the shoulder of the rod after the rod reaching its stop early during the axial movement of the cylinder in the pump body.

The early stopping of the exhaust valve in relation to that of the cylinder therefore makes it possible to proceed with mechanically opening the pump. Indeed, when the exhaust valve is made to stop during a joint axial movement with the cylinder, the sealing seat of the latter separates from the shoulder of the exhaust valve, thus opening the passage channel extending from the dosage chamber to the pump ejection orifice.

Advantageously, the channel is opened by stopping the bottom end of the rod against the means forming the intake valve, the cylinder continuing its axial movement in the pump body. This configuration relates more specifically to the prior phase of evacuating the air contained in the dosage chamber (pump priming phase).

According to another configuration, the channel is opened by stopping the bottom end of the rod under the action of the pressure exerted by the product contained in the dosage chamber, the cylinder continuing its axial movement in the pump body. This configuration relates more specifically to the phase of dispensing the product contained in the dosage chamber.

Advantageously, the exhaust valve is arranged with the cylinder to define a compartment which contains elastic return means of the exhaust valve in the closed position of the channel, the compartment being isolated from the dosage chamber by airtight sealing means. In this way, the spring, which guarantees a perfect seal for the dosage chamber at the top, by pushing the exhaust valve back against the sealing seat of the cylinder, is never in contact with the liquid product. All risk of contamination of the liquid product is thus avoided. According to one particular configuration, the airtight sealing means consist of a radial lip arranged on the top end of the outer wall of the rod.

Advantageously, the dispensing head comprises a conduit for evacuating the air contained in the compartment during the manual movement of the dispensing head on the pump body, the evacuation conduit being arranged above the compartment. This conduit makes it possible to evacuate the air compressed in the compartment during the axial movement of the exhaust valve when activating the pump. It also makes it possible to control the airtightness of the sealing means isolating the compartment from the dosage chamber.

Advantageously, the dispensing head comprises a push button designed to activate the axial movement of the cylinder in the pump body, said push button being fitted on the top of the cylinder by means of a first skirt. According to a particular configuration, the channel is arranged between the outer wall of the cylinder and the inner wall of the fitting skirt.

The pump advantageously comprises elastic means for returning the dispensing head to the inactive position housed between the fitting skirt and a second skirt outside the fitting skirt. Such an arrangement has the advantage that the elastic return means are not in contact with the product, thus avoiding all danger of the latter being contaminated.

The pump advantageously comprises means for support and attachment on a liquid or semi-liquid product dispenser.

According to a second aspect, the invention relates to a dispenser for a liquid or semi-liquid product intended for therapeutic or cosmetic treatment, equipped with a pump according to any preceding claim.

BRIEF DESCRIPTION OF THE DRAWINGS

Further objectives and advantages of the invention will become apparent from the following description made in reference to the appended drawings, wherein.

DETAILED DESCRIPTION OF THE INVENTION

In relation to the figures, the pump as described below is particularly suitable for dispensing a liquid or semi-liquid pharmaceutical product in the form of a nose spray. It is, however, understood that the pump according to the invention can have different shapes and apply to other fields, such as the cosmetic field.

Figure 1:
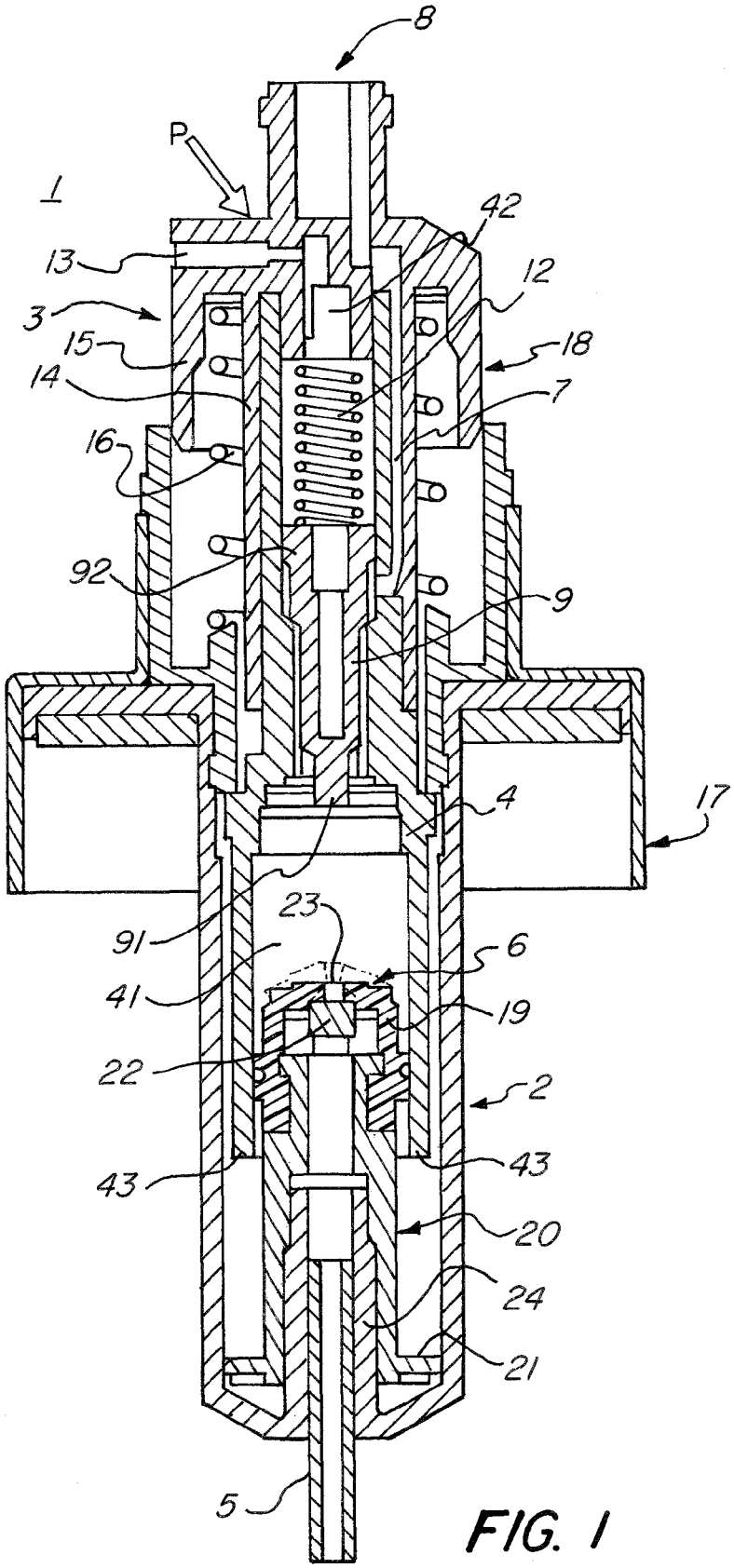
FIG. 1 shows a cross-section view of a pump according to the invention in inactive position.
Figure 2:
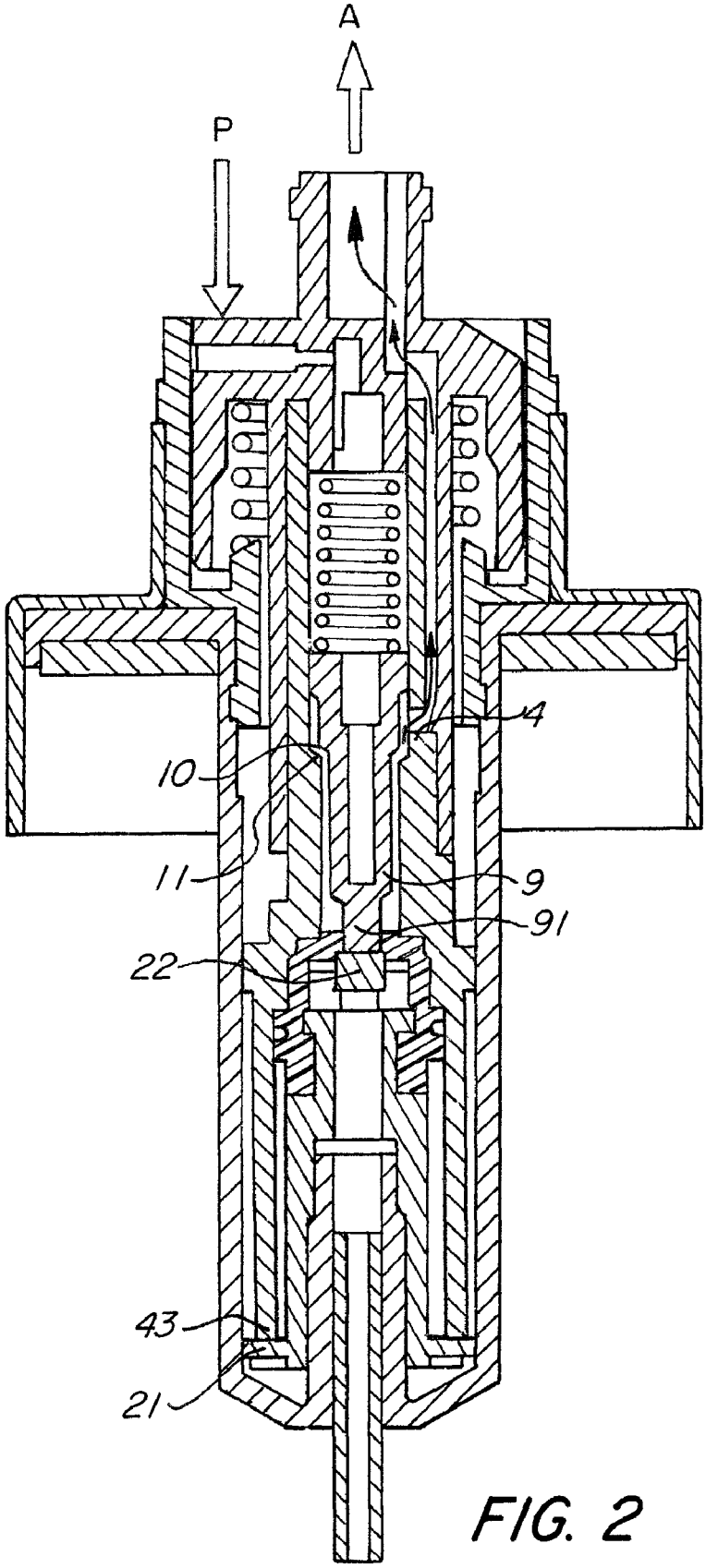
FIG. 2 shows a cross-section view of the pump of FIG. 1 in lowered position.

The pump 1 comprises a pump body 2 and a dispensing head 3 manually movable on the pump body 2 between an inactive position (FIG. 1) and a lowered position (FIG. 2).

The dispensing head 3 comprises a cylinder 4, forming a dosage chamber 41, slidingly mounted in the pump body 2 and an exhaust valve 9 made up of a rod slidingly mounted inside said cylinder 4. The dosage chamber 41 is sealed at the top by the exhaust valve 9, and communicates at the bottom with a liquid intake tube 5 by means of an intake valve 6.

The dispensing head 3 also comprises a push button 18 fitted onto the top of the cylinder 4. The push button 18 comprises two concentric skirts 14, 15, a first skirt 14, called internal skirt, surrounding the cylinder 4, and a second skirt 15, called external skirt, placed separated from the first skirt 14.

The push button 18 is provided with an orifice 8 through which the air contained in the dosage chamber during the priming phase or the dose of product to be dispensed are ejected outside the pump. For this reason, the fluid passes from the dosage chamber 41 to the orifice 8 through a channel 7. According to the described embodiment, the channel 7 is arranged between the outer wall of the cylinder 4 and the inner wall of the first skirt 14.

The dispensing head 3 also comprises means for airtightly sealing the channel 7, preventing the passage of the fluid (air or liquid product to be dispensed) from the dosage chamber 41 towards the dispensing orifice 8 of the dispensing head. The sealing means consist of a shoulder 10 arranged on the outer wall of the rod, capable of coming to rest against a sealing seat 11, with a matching shape, arranged in the cylinder 4. Thus, and as will be seen below, the channel 7 is airtightly sealed by keeping the shoulder 10 of the rod resting against the sealing seat 11 of the cylinder 4, and opened by separating the sealing seat 11 from the cylinder 4 opposite the shoulder 10.

The shoulder 10 of the rod is kept resting against the sealing seat 11 of the cylinder by elastic return means 12 such as a spring. The latter is housed in a compartment 42 defined by the cylinder 4 and the top end of the rod. The spring 12 is mounted by compression in the compartment 42.

In order to prevent the spring 12 from entering into contact with the fluid from the dosage chamber 41, the compartment 42 is isolated from the latter by airtight sealing means 92. In the described embodiment, the airtight sealing means 92 consist of a radial lip 92 arranged on the top end of the outer wall of the rod.

The exhaust valve 9 is advantageously arranged in the cylinder 4 so as to have, when held against the sealing seat of the cylinder 4, in inactive position, a bottom end 91 extending into the dosage chamber 41.

Advantageously, the dispensing head 3 comprises a conduit 13 designed for evacuating the air contained in the compartment 42 during the manual movement of the dispensing head 3 on the pump body 2 and well as for allowing the airtightness of the sealing means 92 to be controlled during industrial assembly. In the described embodiment, the conduit 13 extends above the compartment 42.

Furthermore, the pump is equipped with second elastic return means 16, such as a spring, designed to ensure the elastic return of the dispensing head 3 to its inactive position. In order to prevent the liquid from coming into contact with the spring 16 and being contaminated by the latter, the spring 16 is advantageously housed between the inner skirt 14 and the outer skirt 15 of the push button 18.

In the described embodiment, the intake valve 6 consists of a deformable membrane 19 arranged in the bottom part of the pump body 2. The membrane 19 rests on a tubular support 20 rising into the bottom of the pump body 2.

The bottom end of the support 20 is provided with an external radial extension 21. As will be seen below, the extension 21 has the function of providing a stop for the cylinder 4 moving axially in the pump body 2, the stopping of said cylinder 4 corresponding to the lower position of the pump 1.

The top end of the support 20 is provided with a contact point 22. The membrane 19, comprising an orifice 23, covers the top end of the support 20, the orifice 23 being positioned opposite the contact point 22. In addition to its function of blocking the orifice 23 of the membrane 19, the contact point 22 has the additional function of providing a stop for the exhaust valve 3 for the purpose of priming the pump.

The support 20 is fitted onto the outside of a hollow cylindrical part 24 of the pump body 2, cylindrical part 24 which extends into said pump body 2 and opens onto the bottom part of the latter. The intake tube 5 for the liquid product contained in the dispenser is fitted into the cylindrical part 24 of the pump body 2.

The pump additionally comprises means for support and attachment 17 to allow it to be attached to a dispenser containing the liquid or semi-liquid product to be dispensed.

The operation of the pump is described below.

Prior to dispensing the product contained in the dispenser equipped with a pump such as previously described, it is necessary to evacuate the air trapped in the dosage chamber 41 of said pump. This is the so-called priming phase.

The operating principle of this phase, shown in FIGS. 1 and 2, is as follows: under the action of a manual pressure P (shown by an arrow in FIG. 1) on the push button 18 of the dispensing head 3, the cylinder 4-exhaust valve 9 assembly slides axially in the pump body 2 in the direction of the intake valve 6. The air, trapped in the dosage chamber 41 made airtight at the top by the exhaust valve 9 resting against the sealing seat 11 of the cylinder 4 and at the bottom by the intake valve 6, is then compressed. The cylinder 4-exhaust valve 9 assembly continues its travel until the bottom end 91 of the exhaust valve 9 comes to a stop against the contact point 22 of the membrane support 20. With the valve 9 thus held stopped, the cylinder 4 continues its travel until its bottom end 43 reaches the extension 21 of the membrane support 20. The dispensing head 3 is then in its low position (or end-of-travel position) (FIG. 2).

Continuing its travel, the cylinder 4 is separated from the shoulder 10 of the exhaust valve 9, breaking the seal maintained until this point by the contact between the exhaust valve 9 and the cylinder 4. The channel 7 is then open.

Once the seal is broken, the air compressed in the dosage chamber 41 can escape from the dosage chamber 41 towards the orifice 8 through the open channel 7.

Once the bottom position is reached, the pressure P exerted on the push button 18 of the dispensing head 3 is released. Under the action of the spring 16, the push button 18 rises back to its inactive position, driving with it the rising of the cylinder 4 by sliding inside the pump body 2. During its rise, the sealing seat 11 of the cylinder 4 comes back into contact with the shoulder 10 of the exhaust valve 9, the cylinder 4 driving said valve during its travel. The dosage chamber 41 is then made airtight again by means of the spring 12, the latter pushing the exhaust valve 9 back against the sealing seat 11 of the cylinder 4.

As the dispensing head 3 continues to rise, a depression is created in the dosage chamber 41 which is sealed at the top. When the depression created in the dosage chamber 41 is greater than the force maintaining the seal of the membrane 19 on the contact point 22 of the membrane support 20, the membrane 19 deforms and the liquid product contained in the dispenser is sucked from the dispenser reservoir towards the dosage chamber 41 through the liquid intake tube 5. When the dispensing head 3 reaches the resting position, the depression in the dosage chamber 41 stops and the membrane 19 returns to its airtight position on the contact point 22 of the membrane support 20.

This operation is repeated until all the air contained in the dosage chamber 41 has been evacuated. The priming phase ends when the air contained in the dosage chamber has been entirely replaced with the product to be dispensed. The product contained in the dispensing chamber 41 then corresponds to one dose of the product to be dispensed.

Once the priming phase has ended, the pump 1 enters its product dispensing phase, known as the liquid phase. The liquid phase is shown in FIGS. 3 to 6.

Under the action of a downward manual pressure P (shown by an arrow in FIG. 4) on the push button 18 of the dispensing head 3, the cylinder 4-exhaust valve 9 assembly slides again in the pump body 2 in the direction of the intake valve 6. However, under the action of the pressure exerted by the product contained in the dosage chamber 41, the exhaust valve 9 remains in its travel. Continuing its travel, the cylinder 4 then separates from the shoulder of the exhaust valve 9, thus breaking the seal between the valve and the sealing seat 11 of the cylinder 4. The channel 7 is then open.

Figure 4:
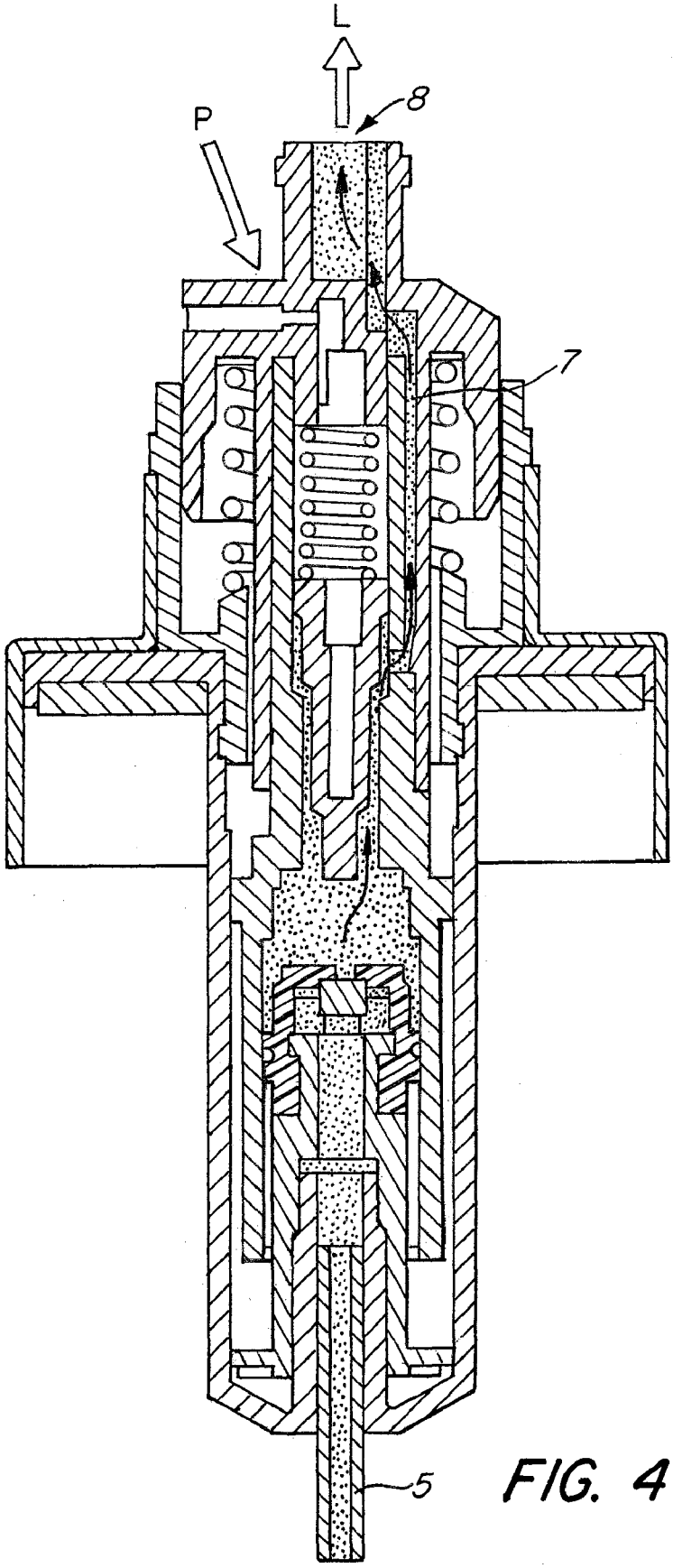

Once the seal is broken, the product contained in the dosage chamber 41 can then pass into the open channel 7 to be expelled out of the pump 1 through the orifice 8 (FIG. 4).

Figure 5:
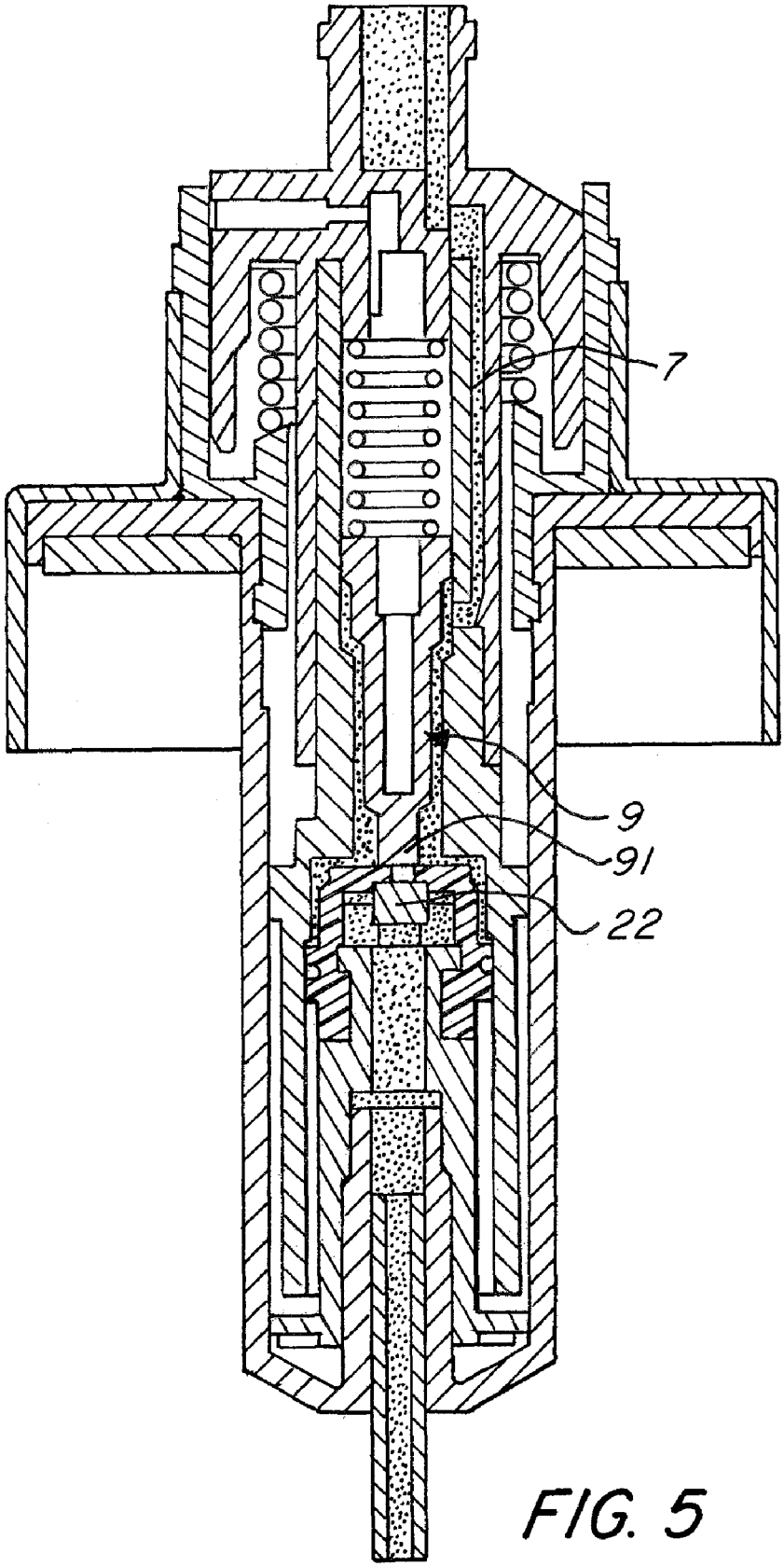

The cylinder 4 and the exhaust valve 9, kept separated from one another under the action of the product contained in the dosage chamber 41, continue their travel together until the bottom end of the cylinder 4 reaches the extension 21 of the membrane support 20. The lower position of the dispensing head 3 then corresponds to the complete dispensing of the product dose contained in the dosage chamber 41 (FIG. 5).

Once the bottom position is reached, the pressure P exerted on the push button 18 of the dispensing head 3 is released. As in the priming phase, the push button 18 rises back to its inactive position under the action of the spring 16, driving with it the rising of the cylinder 4 by sliding inside the pump body 2. During its rise, the sealing seat 11 of the cylinder 4 comes back into contact with the shoulder 10 of the exhaust valve 9, the cylinder then driving the exhaust valve 9 during its travel. The dosage chamber 41 is then made airtight again by means of the spring 12, the latter pushing the exhaust valve 9 back against the sealing seat 11 of the cylinder 4.

Figure 3:
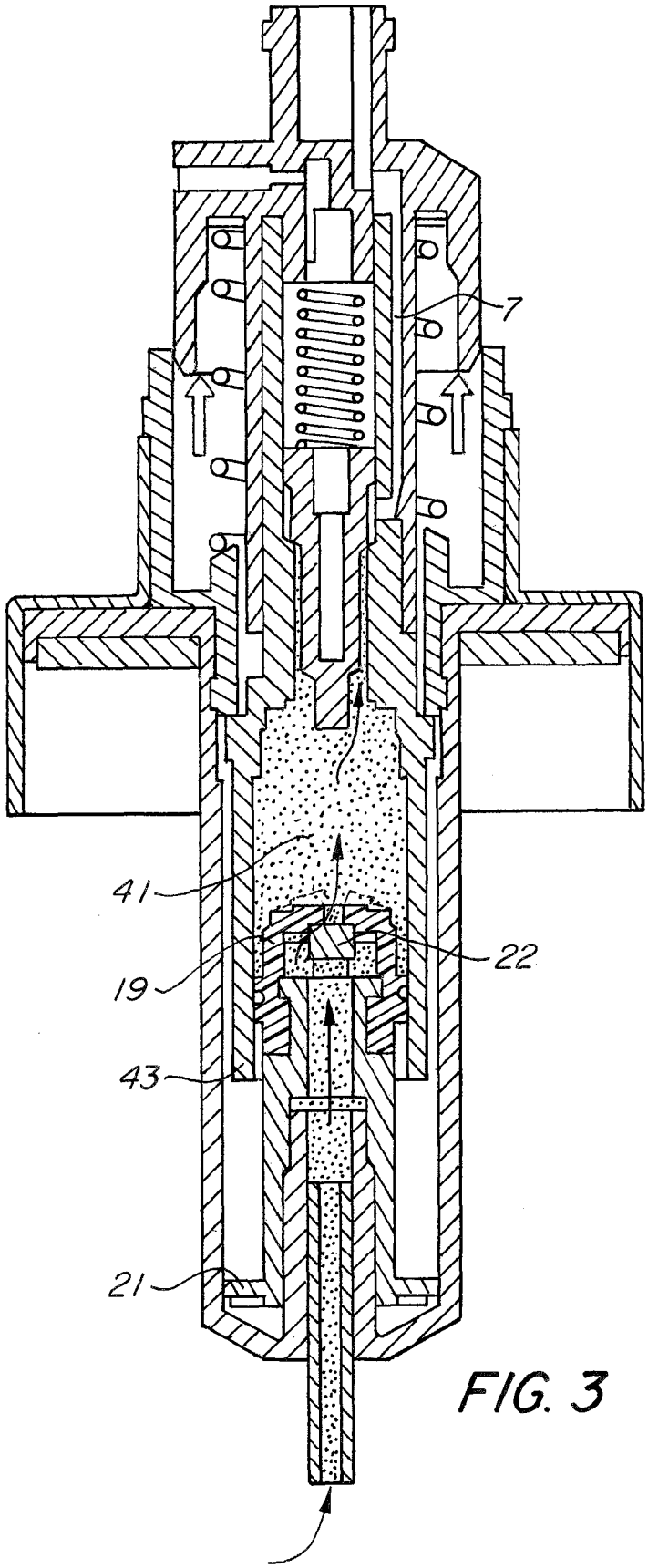
FIG. 3 to 6 show cross-section views of the pump of FIG. 1, shown in different steps of its activation during the dispensing of the liquid product.
Figure 6:
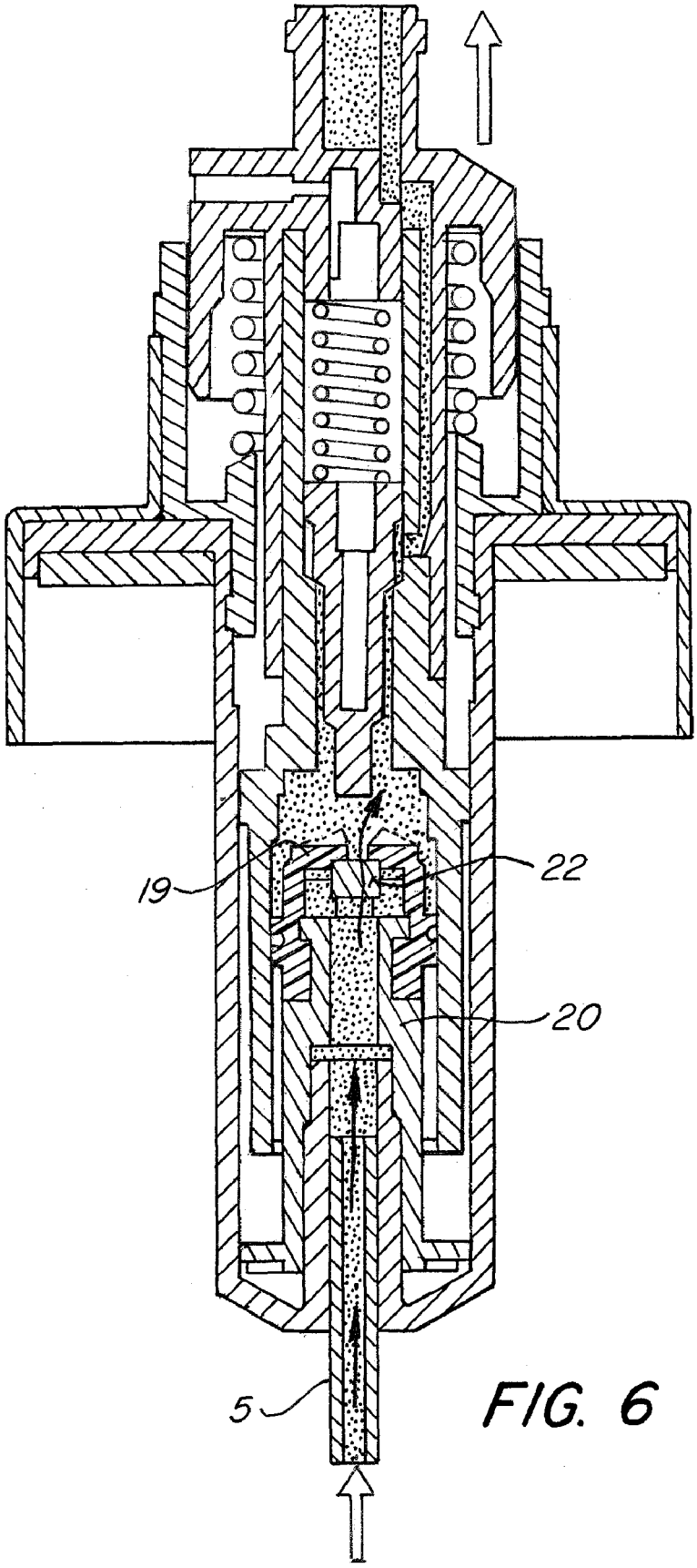

As the dispensing head continues to rise, a depression is created in the dosage chamber 41 which is sealed at the top. When the depression created in the dosage chamber 41 is greater than the force maintaining the seal of the membrane on the contact point 22 of the membrane support 20, the membrane 19 deforms and the product contained in the dispenser is sucked from the dispenser reservoir towards the dosage chamber 41 through the liquid intake tube 5 (FIG. 6). When the dispensing head 3 reaches its inactive position, the depression in the dosage chamber 41 stops. The membrane 19 then returns to its sealed position on the point 22 of the membrane support 20 (FIG. 3).

The invention is described above as an example. It is understood that those skilled in the trade are capable of creating different variations of the invention without departing from the invention.

What is claimed is:

1. A pump for dispensing a liquid or semi-liquid product, designed to be used, in particular, in the pharmaceutical or cosmetic field, said pump comprising a pump body and a dispensing head manually movable on the pump body between an inactive position and a punctual product-dispensing position, the dispensing head comprising:

a cylinder forming a dosage chamber, said chamber communicating with a liquid intake tube by means of a device forming an intake valve, said cylinder being slidingly mounted in the pump body;

a channel allowing the product or air to pass from the dosage chamber towards an ejection orifice of the liquid product or air, an exhaust valve made up of a rod, the bottom end of which seals the dosage chamber at the top, and which comprises means for airtightly sealing the channel consisting of a peripheral shoulder capable of coming to a rest against a matching sealing seat, the channel being opened by separating the shoulder from the seat of the cylinder after the rod reaching its stop early during the axial movement of the cylinder in the pump body and, a push button fitted onto the top part of the cylinder by means of a first skirt and designed to activate the axial movement of the cylinder, characterised in that said sealing seat is arranged in the cylinder, while the channel is arranged between the outer wall of the cylinder and the inner wall of the first skirt.

2. The pump according to claim 1, characterised in that the channel is opened by stopping the bottom end of the rod against the means forming the intake valve early.

3. The pump according to claim 1, characterised in that the channel is opened by stopping the bottom end of the rod early under the action of the pressure exerted by the product contained in the dosage chamber.

4. The pump according to claim 1, characterised in that the exhaust valve is arranged with the cylinder to define a compartment which contains elastic return means of the exhaust valve in the closed position of the channel, the compartment being isolated from the dosage chamber by airtight sealing means.

5. The pump according to claim 4, characterised in that the airtight sealing means consist of a radial lip arranged on the top end of the outer wall of the rod.

6. The pump according to claim 1, characterised in that it comprises elastic means for returning the dispensing head to the inactive position housed between the fitting skirt and a second skirt outside the fitting skirt.

7. The pump according to claim 4, characterised in that the dispensing head comprises a conduit for evacuating the air contained in the compartment during the manual movement of the dispensing head on the pump body, the evacuation conduit being arranged above the compartment.

8. The pump according to claim 1, characterised in that it comprises means for support and attachment on a liquid or semi-liquid product dispenser.

9. A dispenser for a liquid or semi-liquid product intended for therapeutic or cosmetic treatment, equipped with a pump according to claim 1.

10. The pump according to claim 5, characterised in that the dispensing head comprises a conduit for evacuating the air contained in the compartment during the manual movement of the dispensing head on the pump body, the evacuation conduit being arranged above the compartment.

11. The pump according to claim 6, characterised in that the dispensing head comprises a conduit for evacuating the air contained in the compartment during the manual movement of the dispensing head on the pump body, the evacuation conduit being arranged above the compartment.

* * * * *

UNITED STATES PATENT AND TRADEMARK OFFICE

CERTIFICATE OF CORRECTION

PATENT NO. : 7,882,988 B2
APPLICATION NO. : 12/143461
DATED : February 8, 2011
INVENTOR(S) : Francois Nicolle et al.

It is certified that error appears in the above-identified patent and that said Letters Patent is hereby corrected as shown below:

Title Page, Item (75) Inventors should read

(75) Inventors: Francois Nicolle, Tourville La Chapelle (FR);
David Leuliet, Woincourt (FR)

Signed and Sealed this
Tenth Day of May, 2011

David J. Kappos

David J. Kappos
*Director of the United States Patent and Trademark Office*